US005829335A

United States Patent [19]

Ewald et al.

[11] Patent Number: 5,829,335

[45] Date of Patent: Nov. 3, 1998

[54] CONTROL FOR HYDRAULIC DRIVE OR ACTUATOR

[75] Inventors: Roland Ewald, Lohr; Andreas Grimm, München, both of Germany

[73] Assignee: Mannesmann Rexroth GmbH, Lohr, Germany

[21] Appl. No.: 755,852

[22] Filed: Dec. 9, 1996

Related U.S. Application Data

[63] Continuation of Ser. No. 373,231, filed as PCT/EP94/01530 May 11, 1994, abandoned.

[30] Foreign Application Priority Data

May 11, 1993 [DE] Germany ..... 43 15 626.6

[51] Int. Cl.[6] ..... F15B 9/03

[52] U.S. Cl. ..... 91/363 A; 91/363 R; 364/172

[58] Field of Search ..... 91/361, 363 R, 91/363 A; 364/167.01, 172, 174, 175

[56] References Cited

U.S. PATENT DOCUMENTS

| | | | |
|---|---|---|---|
| 3,724,330 | 4/1973 | Mason | 91/363 A |
| 3,917,930 | 11/1975 | Davey et al. | 364/167.01 |
| 4,011,437 | 3/1977 | Hohn | 364/174 |
| 4,336,745 | 6/1982 | Lund | 91/361 |
| 4,617,637 | 10/1986 | Chu et al. . | |
| 4,665,352 | 5/1987 | Bartelt et al. | 364/174 |
| 4,744,218 | 5/1988 | Edwards et al. | 91/361 |
| 4,901,624 | 2/1990 | Feuser . | |
| 4,901,625 | 2/1990 | Bussan et al. | 91/361 |
| 4,902,947 | 2/1990 | Ako . | |
| 5,218,820 | 6/1993 | Sepehri et al. | 91/435 |
| 5,218,895 | 6/1993 | Lukich et al. | 91/361 |

FOREIGN PATENT DOCUMENTS

| | | |
|---|---|---|
| 0070957 | 2/1983 | European Pat. Off. . |
| 2607818 | 9/1977 | Germany . |
| 3532931 | 4/1987 | Germany . |
| 2111253 | 6/1983 | United Kingdom . |
| 2252424 | 8/1992 | United Kingdom . |

OTHER PUBLICATIONS

Pritschow & Hagel, Automatisierte inbetriebnahme zustandsgeregelter Antriebssysteme, 1990, pp. 544–547, Olhydraulic and Pneumatic.

Regelungstechnik, vol. 32, No. 9 Sep. 1984, Munich, DE pp. 309–316.

Olhydraulic und Pneumatik, vol. 99, No. 9 Sep. 1985, Mainz, DE pp. 669–677, M. Egner et al.

*Primary Examiner*—F. Daniel Lopez

*Attorney, Agent, or Firm*—Cushman Darby & Cushman IP Group of Pillsbury Madison & Sutro LLP

[57] ABSTRACT

A control for a hydraulic drive or actuator is provided, wherein the actuator has pressurized operating fluid applied thereto, and wherein the operating fluid is directed through an electrically controlled valve for establishing the amount of operating fluid to be fed to the actuator. An electrical signal for controlling the valve is provided by a computing device. In the computing device, a predetermined desired value for the position (or travel), force, or pressure of the actuator or drive is continuously calculated based, at any given time, at least on one measured or simulated state variable indicative of a condition of the drive or actuator at the time of calculation. The calculated desired value determines the amplitude of the electrical signal directed to an electrical actuating device of the valve. The computing speed of the computing device for determining the respective desired value is faster than the actuating velocity or speed of the valve.

7 Claims, 2 Drawing Sheets

CONTROL FOR HYDRAULIC DRIVE OR ACTUATOR

This is a continuation of application Ser. No. 08/373,231, filed as PCT/EP94/01530 May 11, 1994, which was abandoned upon the filing hereof.

BACKGROUND OF THE INVENTION

1. Field of the Invention

The present invention relates to a control for a hydraulic drive or actuator.

2. The Prior Art

With known controls, a feedback value (a variable signal governing the feedback control) is iteratively determined over time and therefore is corrected until the actuator means provides the desired characteristic or the desired value. These known controls may only be utilized for control programs running over a short period of time due to the time consuming empirical determination of the desired value for the opening of a valve. Therefore, for an actuator or actuators having a long path of movement or movement sequence, feedback control devices are used in which the essential feature resides in the comparison of the desired value with the actual value determined by variables of a state or condition such as position, velocity, force, or pressure. To keep the deviation between the desired and actual values (loss in amplitude and phase lag) as small as possible, additional variables influencing the actuator are added to the desired value via computers. For the calculation of the desired value which is to be corrected, a frequency analysis is used.

In a known control method, frequency analysis is applied for each control axis (i.e. each drive means) for calculating the corrected desired value. In a preliminary identification the frequency characteristic, and thus the transient response of each servo hydraulic control axis, is determined. Then, a frequency analysis is also carried out for the curve of the desired value to be followed to enable the calculation of the correct desired values for the servo hydraulic control axes using the transient responses obtained in the identification run.

The calculation of the corrected desired value must occur before a real test run, the measured transient response and the corrected desired value calculated therefrom being stored in a digital computer.

It is to be noted that in the mathematical calculation process for determination of the corrected desired value of a regulator or closed loop control circuit, the system matrix obtained during identification cannot be applied directly. It is required to invert the system matrix and to transform the curve of the desired value into the frequency domain. Only after mathematical calculation in the frequency domain, can the calculated signal of the desired value be retransformed into the time domain. The calculation programs are applicable only for a particular time window or time frame.

A curve of the desired value which is longer in time therefore must be divided or partitioned into respective individual time intervals or time steps. Agreement between the desired value and the actual value is not to be expected after the first calculation of the desired value. A better approximation is achieved by subsequent calculations of the corrected desired value. Therein, the curve of the actual value of the last test run is taken as a reference for the comparison of the desired and the actual values.

With these known control and calculation methods satisfactory results may be achieved when there is, for example, a positional control in which the velocity proportion or share is predominant and in which the load pressure only varies within small ranges, the oil compression proportion or share being small in percentage due to small dynamic variations of force and load being used, or if the variation of load pressure is identical for the entire frequency range of the preliminary identification as well as for the entire frequency range of the predetermined curve of the desired value.

For closed loop controls in which variations of force, and thus of pressure, occur dynamically very quickly, or for controls having higher dynamics and thus a higher dynamic proportion or share of mass, such a known control and calculation method provides results which are useful only to a limited extent since there is no linear relationship between the amount of flow and the degree of opening of the valve whereby the proportion of oil compression may have a predominant influence. In cylinder drives, the proper mathematical assessment or evaluation of the proportions or shares of oil compression is made more difficult by the fact that at each point in time the corresponding oil volume to be compressed, and thus the position of the piston rod of the cylinder, also must be considered in the calculation.

For an off-center position of the piston, the resulting different amounts of oil in the cylinder chambers, and the different volumes of the conduits between the valve and the cylinder result in different values of flow at the metering edges at the servo or control valve. For the calculation of the proper degree of opening of the valve, the actual pressure drop at the metering edges also must be considered.

This is likewise true for condition or status controlled drive systems as described in the article "Automatisierte Inbetriebnahme zustandsgeregelter Antriebssysteme" by Günter Pritschow and Rainer Hagl in "Olhydraulik und Pneumatik" 34 (1990), vol. 8, p. 544–547 as well as for digital nonlinear control and identification methods described in the article "Digitale, Nichtlineare Regelungen und Identifikationsverfahren fur Elektro-hydraulische Vorschubantriebe" by M. Egner and G. Keuper in "Olhydraulik und Pneumatik" 29 (1985), vol. 9, p. 669–677. With those controls the follow-up error may be reduced compared to simple regulators or closed loop controls. Particularly during large and quick changes of load and velocity, this control error cannot be completely eliminated.

SUMMARY OF THE INVENTION

It is the object of the invention to improve the control of hydraulic actuators or drives according to a predetermined curve of desired operation values in which time consuming optimization runs with several test runs may be eliminated and in which the curve of the actual values largely corresponds to the curve of the desired values for movement of the hydraulic drive or actuator.

This object is achieved by providing a control wherein a high speed computing device continuously calculates a valve control value based upon the predetermined curve or characteristic function of at least one operating parameter of the drive or actuator. Such operating parameters may include a desired value for movement or a desired value for the force or pressure of the drive or actuator, respectively. The calculation for each valve control value is also based at any given time on at least one measured or simulated state variable (condition variable) of the drive or actuator at the time of calculation, and the calculated valve control value is applied to the valve as an electrical signal.

It is advantageous to use simulated values of the condition (status variables) instead of measured condition or status values or variables for the continuous calculation of the valve control value because sensors for detecting the condition or status variables may be eliminated. It is also advantageous if the simulated condition or status variables are available in parallel to the measured condition or status variables (i.e. are available or calculated simultaneously) so that if a sensor fails or a predetermined limit (band width) is exceeded for the measured condition or status variables—i.e. a situation which may be attributed to failure of the control—the respective simulated condition or status variables may be used for calculating the valve control value.

Further embodiments of the present invention may be gathered from the following detailed description of a preferred embodiment.

Due to the "previewing" or anticipating calculation of the valve control value, absolutely no follow-up error occurs in connection with the movement of the actuator. The ongoing implication of the current or actual operating conditions of the drive or actuator system in the continuous calculation of the valve control value mathematically takes into account the exact physical influences of the oil compression and the nonlinear dependence of the load pressure.

Further, when calculating the valve control value, the present invention also takes into account other influences such as sudden changes in load pressure at the control edges or metering edges of the 4-way directional control valve when going through zero, load pressure dependent zero leakage of the servo valve (in particular in the center position of the valve) as well as load pressure dependent leakage of hydrostatically mounted servo cylinders, said influences being very important to achieving an exact sequence of movement, force, or pressure values.

In regulator loops, that is, closed loop controls with one or more control axes, dynamic forces or pressures acting on the servo hydraulic control axis are calculated on-line in a previewing or anticipating fashion. In systems having multiple control axes, the coupling of forces of the axes with each other is determined by a cinematic or geometry computer. The dynamic forces, or pressures, of each servo hydraulic axis are mathematically taken into account when calculating the valve control value. The load pressure and external forces are determined in each calculating step by measurements and are continuously considered when calculating the valve control value. As a result, convergent solutions are provided for a broader frequency range.

The additional closed loop circuit for position, force and pressure, is merely provided to fix the cylinder with respect to position, force and pressure, respectively, if errors such as long term errors are present in the calculation of the valve control value. The additional closed loop circuit is not active during proper calculation of the valve control value.

DESCRIPTION OF THE PREFERRED EMBODIMENTS

Figure 1:
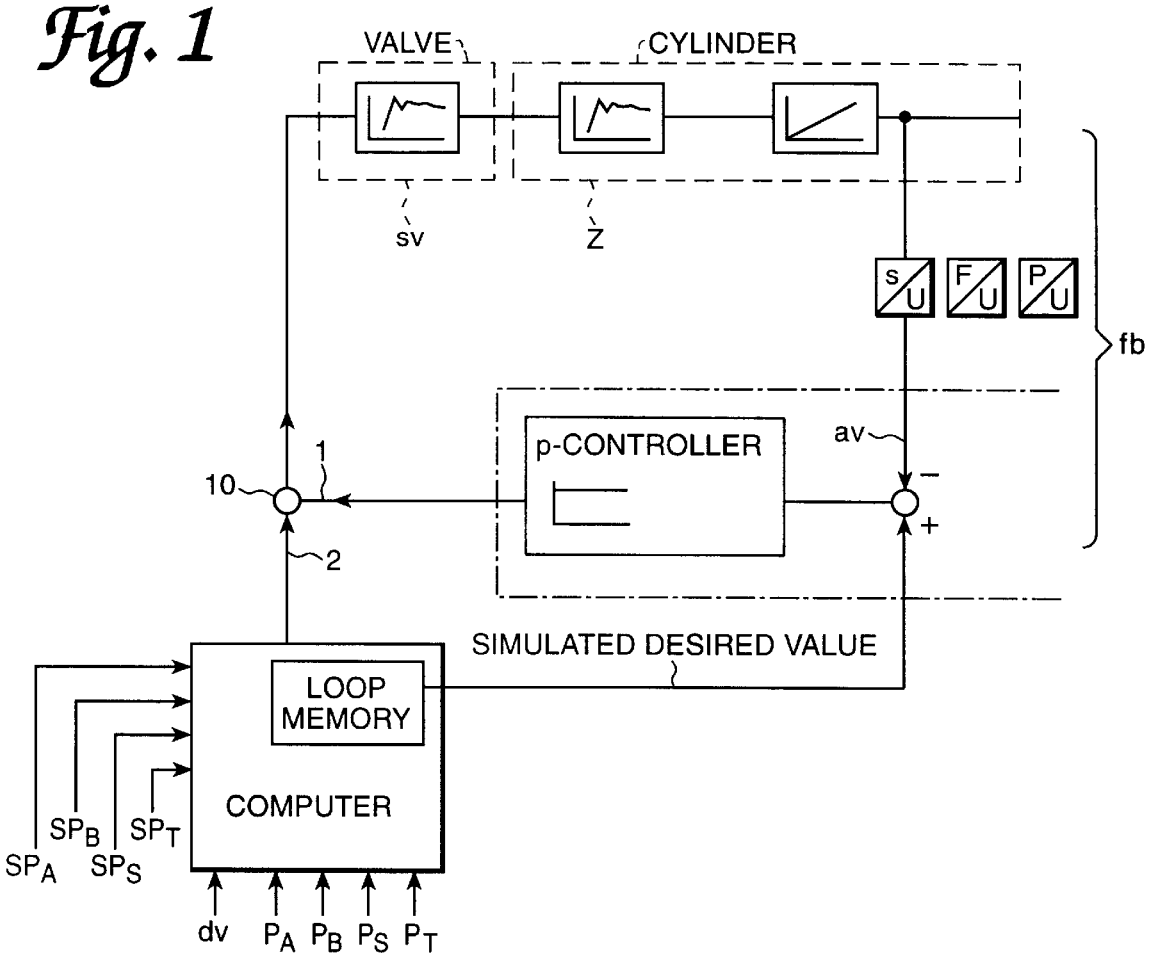
FIG. 1 is a block diagram of a control according to the present invention for a hydraulic cylinder having a piston rod extending through the piston (synchronous cylinder)
Figure 2:
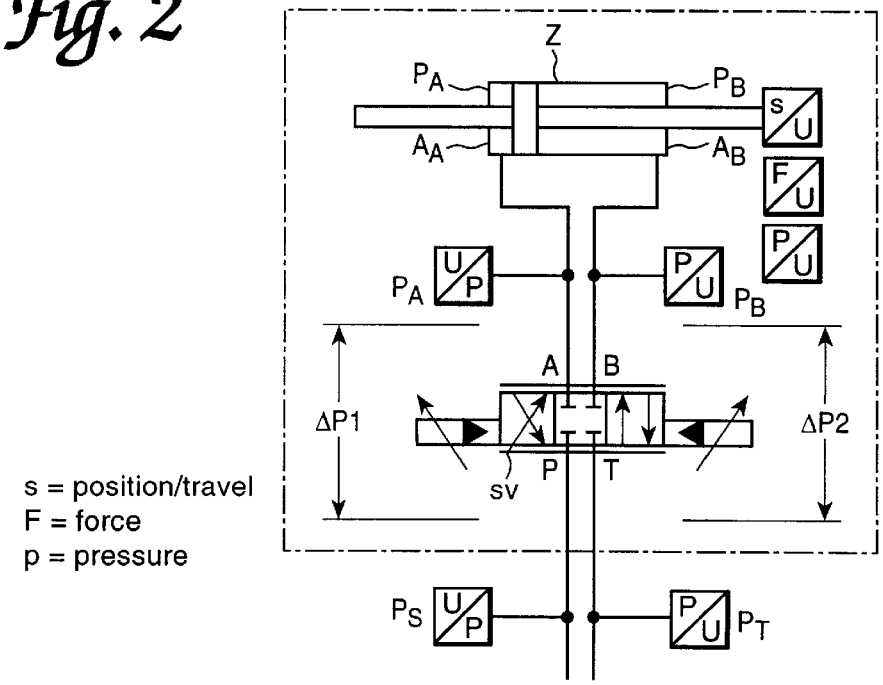
FIG. 2 is a schematic illustration of a hydraulic drive in the form of a hydraulic cylinder having a piston rod extending through the piston (synchronous cylinder)

With reference to FIGS. 1 and 2, in a computer R such as a transputer, a desired value for the actuator or cylinder speed, a desired value for the actuator) or cylinder travel or position, and the dynamic forces acting on the cylinder (generally: a drive or actuator) Z and resulting from the curve of the desired value of acceleration are continuously calculated from the predetermined curve of the desired value for acceleration, force and pressure, respectively, of the cylinder and the corresponding masses of the actuator or drive.

Further, a continuous calculation of the current (actual differential in pressure (differential of force) at cylinder Z or at the oil pump is carried out on the basis of the measured or simulated cylinder chamber pressures $P_A$ and $P_B$ in the cylinder chambers $A_A$, $A_B$. A continuous calculation is made of the current pressure drops $\Delta P1$ and $\Delta P2$ at the metering or control edges of servo valve SV on the basis of the measured or simulated cylinder chamber pressures $P_A$ and $P_B$ and the system pressure $P_S$ and reservoir pressure $P_T$. Thus, the measured cylinder chamber pressures have a dual function. Measurement and simulation, respectively, of the cylinder chamber pressures $P_A$ and $P_B$ is required for the determination of the load pressure and of the pressure drop at the metering edges of valve SV. Measurement and simulation, respectively, of the system pressure $P_S$ and of the reservoir pressure $P_T$ are only required if those conditions or status variables are not constant. In FIG. 1, the simulated pressures are designated by reference to $SP_A$, $SP_B$, $SP_S$ and $SP_T$. The measured pressures are designated by $P_A$, $P_B$, $P_S$ and $P_T$. The actual values of cylinder position S and of force F, respectively, or of pressure P and of acceleration at or in the operating cylinder are also continuously measured.

From the established desired and actual values a valve control value is continuously calculated taking into account the transfer behavior (transfer function) of the system to be controlled. The valve control value for the valve is fed to the input 2 of a summing circuit 10. The system to be controlled can be, for example, a "servo hydraulic axis". The calculation of the valve control value is continuously carried out on-line according to known mathematical and physical relationships using the actual measured or simulated system data of the servo hydraulic axis at the time for the continuous curve of desired and actual values (i.e. for the desired and actual values, which are variable with time).

The following is taken into account when calculating each valve control value:

the current (or actual) measured or simulated chamber pressures $P_A$, $P_B$, $P_S$, and $P_T$, or $SP_A$, $SP_B$, $SP_S$, and $SP_T$, the currently (or actually) measured cylinder position (or travel) S, and the currently measured force F and the pressure P at and in the working cylinder Z, respectively, the amounts of flow required for the desired velocity (speed) and oil compression, the influence of a $\Delta p$ change at the control edges at a zero crossing (or transient condition) of the 4-way servo valve SV, the influence of zero flow (caused by the positive or negative overlap of the control spool) through the 4-way servo valve in relation to the difference in load pressure between $P_A$ and $P_B$, the influence of the interior and exterior leakages of hydrostatically mounted servo cylinders as a function of or in relation to the differences in load pressure and the actual chamber pressures, the influence of the dynamics of the valve and of the controlled subsystem (system under control), and the actual static forces and dynamic forces of mass acting on cylinder Z. By doing so, the static differences in load pressure and in force pressure (differences which are primarily caused by outer static forces) are continuously determined from the measurements or simulations of the actual chamber pressures $P_A$ and $P_B$. The dynamic mass proportion or share (i.e. the proportion of moved mass) is determined by measurement or simulation of the chamber pressures and of the actual acceleration.

The time delay at the servo valve SV and of the measured signals is compensated by anticipated or advance calculation of the valve control values and by timely outputting the calculated values.

Figure 3:
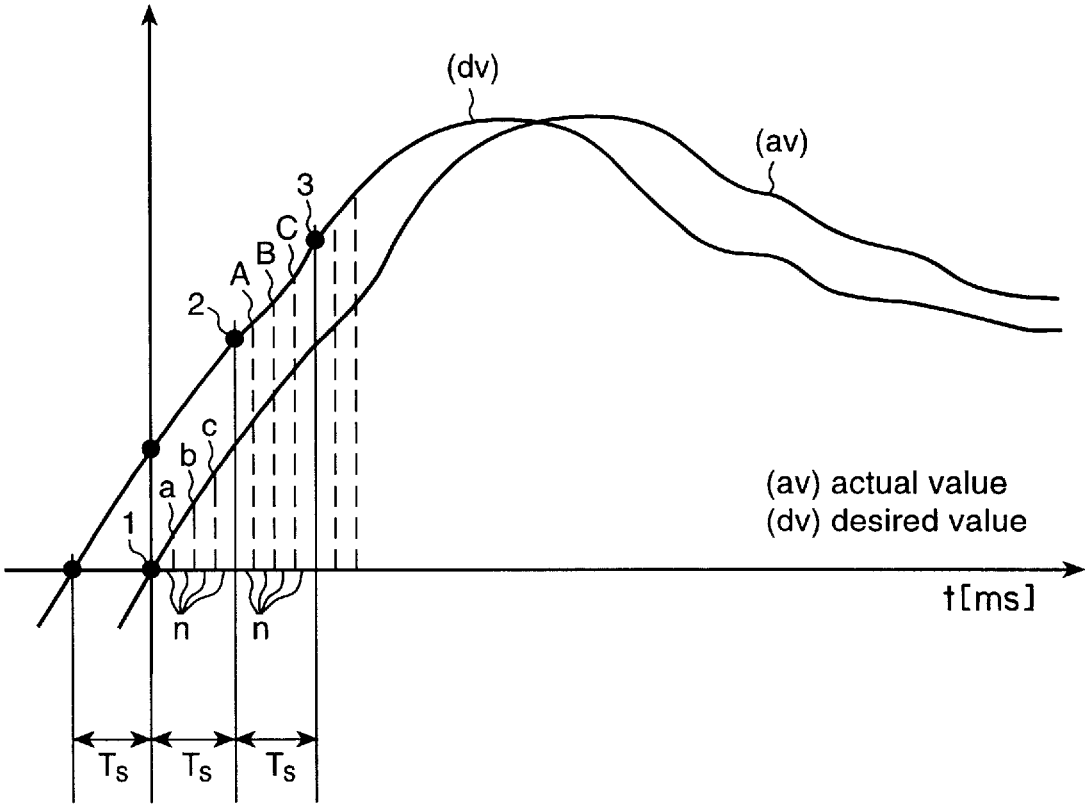
FIG. 3 is a diagram of the curve or characteristic of the desired value of acceleration of a hydraulic drive according to FIGS. 1 and 2.

Since an on-line calculation occurs in the embodiment operating as shown in FIG. 3, it must be assured that the valve control value for the point in time 2 associated with the desired value of velocity, force, or pressure of the cylinder is calculated at time 1 (O ms), and is fed into the summing circuit 10 shown in FIG. 1. The output corresponding to the valve control value for the time 2 must occur timewise in the interval or region between the time 1 and a time which is equal to time 1 plus a time constant $T_s$ of the overall system. The time constant $T_s$ of the overall system corresponds to a time necessary for the entire system comprising the control, drive mechanism, the valve, and the sensors to operate and for the measuring technique to be carried out. So as to be able to calculate the curve or characteristic of the valve control value with sufficient precision, the curve is divided into n single intervals or steps, as shown in FIG. 3, within the time interval Ts. Four calculations of the valve control value are carried out based on the respective measured or simulated values. Thus, apart from the calculation of the valve control value for the time 2, three more calculations of the valve control value for times A, B, and C are carried out based on respective measured or simulated values a, b, c, wherein those intermediate calculations are based in particular on fixed values as determined for the desired value at time 2. The precision of the calculations is further enhanced if the curve of the desired values (dv) (i.e. the desired values as a function of time) over an interval greater than Ts, i. e. after time 2 and 3, respectively, is taken into consideration or incorporated into the mathematical calculation of the valve control value at time 2 by further calculation steps for each interval Ts which is divided into n intervals. For calculating the valve control value 2 on the basis of-the measured or simulated value 1, the data associated with the desired value 3 are taken into account or incorporated into the calculation. For the precision of the expected result it is necessary to have a short and constant computing time. Therefore, the computing operations of the n partitioned intervals or steps are carried out in parallel by using transputers or fast computers operating in parallel. The total computing time for a valve control value is less than 1 ms. Specifically, it is possible to improve the result of the calculations by more finely dividing the calculation of the valve control values. Also, the results of the preceding calculations can be taken into consideration.

In the closed loop circuit of FIG. 1 for controlling position, force, or pressure, the measured actual value of position, force, or pressure of the cylinder is read and compared with the desired value for position, force, or pressure, the simulated desired value (sdv) having been calculated earlier by an amount corresponding to the time constant of the closed loop control system. The simulated desired value for position, force, or pressure is held for the meantime in a loop memory (LM). If the valve control value 2 is calculated correctly, there will be no signal at the input 1 to the summing circuit 10 of the closed loop control (FIG. 1). The closed loop control circuit for position is only provided to balance long term errors, i. e. for fixing the position of the cylinder. The same is true if the control is designed for the curve designating values of force or pressure in a hydraulic cylinder or motor. In this case, the measured actual force or the measured actual pressure is fed back (fb) into a closed loop control circuit for force and pressure, respectively, and it is compared there to the simulated desired values for force and pressure, respectively, which are introduced at that point in the circuit.

The precision of the result is further improved on-line by continuously checking the parameters for the calculation of the desired value. If there are differences between the desired value and the actual value, the computing algorithm (i.e. the algorithm for calculating the valve control value) is changed such that for subsequent calculations of the valve control value smaller differences between the desired value and the actual value are achieved. This correction of the parameters is continued until the error is within an allowed error window or error frame.

We claim:

1. A control system for a hydraulic actuator and an associated electrically controlled valve which determines an amount of operating fluid to be supplied to said actuator in response to an electrical valve control signal, said control system comprising:

a high speed computing device for continuously calculating a valve control value based upon:

a predetermined curve of at least one operating parameter of the actuator, said operating parameter being selected from a group of operating parameters consisting of a desired value for movement of the actuator, a desired value for pressure in the actuator, and a desired value for a force exerted by the actuator; and at any given time, at least one state variable indicative of a present state of the actuator at a time of calculation, said at least one state variable including a state variable indicative of a pressure differential between control edges of the valve, said valve control value being applied to said valve as said electrical valve control signal, wherein a simulated version of said at least one state variable is available in parallel to a measured version thereof to thereby facilitate use of the simulated version to calculate said valve control value when there is a failure of a sensor which provides said measured version or a predetermined limit of the measured version is exceeded.

2. A control system for a hydraulic actuator and an associated electrically controlled valve which determines an amount of operating fluid to be supplied to said actuator in response to an electrical valve control signal, said control system comprising:

a high speed computing device for continuously calculating a valve control value based upon:

a predetermined curve of at least one operating parameter of the actuator, said operating parameter being selected from a group of operating parameters consisting of a desired value for movement of the actuator, a desired value for pressure in the actuator, and a desired value for a force exerted by the actuator; and at any given time, at least two state variables indicative of a present state of the actuator at a time of calculation, said at least two state variables including a state variable indicative of a pressure differential between control edges of the valve, and another state variable indicative of pressure of the operating fluid being supplied to the actuator, said pressure of the operating fluid being present between the valve and an operating chamber of the actuator, said valve control value being applied to said valve as said electrical valve control signal.

3. A control system for a hydraulic actuator and an associated electrically controlled valve which determines an amount of operating fluid to be supplied to said actuator in response to an electrical valve control signal, said control system comprising:

a high speed computing device for continuously calculating a valve control value based upon:

a predetermined curve of at least one operating parameter of the actuator, said operating parameter being selected from a group of operating parameters consisting of a desired value for movement of the actuator, a desired value for pressure in the actuator, and a desired value for a force exerted by the actuator; and at any given time, at least one state variable indicative of a present state of the actuator at a time of calculation, said at least one state variable including a state variable indicative of a pressure differential between control edges of the valve, said valve control value being applied to said valve as said electrical valve control signal, wherein there exists a time period which is defined by the response time for said control, said valve, and said actuator, and said computing device calculates pressure values for a future time defined by said time of calculation plus said time period, and wherein said pressure values are utilized in conjunction with said at least one state variable.

4. A control system for a hydraulic actuator and an associated electrically controlled valve which determines an amount of operating fluid to be supplied to said actuator in response to an electrical valve control signal, said control system comprising:

a high speed computing device for continuously calculating a valve control value based upon:

a predetermined curve of at least one operating parameter of the actuator, said operating parameter being selected from a group of operating parameters consisting of a desired value for movement of the actuator, a desired value for pressure in the actuator, and a desired value for a force exerted by the actuator; and at any given time, at least one state variable indicative of a present state of the actuator at a time of calculation, said at least one state variable including a state variable indicative of a pressure differential between control edges of the valve, said valve control value being applied to said valve as said electrical valve control signal, wherein the electrical valve control signal is supplied to the valve via a summing circuit having first and second inputs, said first input of the summing circuit being connected to receive the electrical valve control signal, and said second input of the summing circuit being connected to an output signal of a closed loop circuit for controlling position, force, or pressure of the actuator.

5. A control system for a hydraulic actuator and an associated electrically controlled valve which determines an amount of operating fluid to be supplied to said actuator in response to an electrical valve control signal, said control system comprising:

a high speed computing device for continuously calculating a valve control value based upon:

a predetermined curve of at least one operating parameter of the actuator, said operating parameter being selected from a group of operating parameters consisting of a desired value for movement of the actuator, a desired value for pressure in the actuator, and a desired value for a force exerted by the actuator; and at any given time, at least one state variable indicative of a present state of the actuator at a time of calculation, said at least one state variable including a state variable indicative of a pressure differential between control edges of the valve, said valve control value being applied to said valve as said electrical valve control signal, wherein amounts of compression resulting from changes in acceleration, force, or pressure and also amounts of leakage flow occurring at the actuator and being dependent on pressure in operating chambers of the actuator are taken into account by the computing device during calculation of the valve control value.

6. A control system for a hydraulic actuator and an associated electrically controlled valve which determines an amount of operating fluid to be supplied to said actuator in response to an electrical valve control signal, said control system comprising:

a high speed computing device for continuously calculating a valve control value based upon:

a predetermined curve of at least one operating parameter of the actuator, said operating parameter being selected from a group of operating parameters consisting of a desired value for movement of the actuator, a desired value for pressure in the actuator, and a desired value for a force exerted by the actuator; and at any given time, at least one state variable indicative of a present state of the actuator at a time of calculation, said at least one state variable including a state variable indicative of a pressure differential between control edges of the valve, said valve control value being applied to said valve as said electrical valve control signal, wherein said computing device is arranged so as to calculate a desired value for a position of the actuator from a desired value for acceleration or velocity of the actuator and is further arranged so as to store said desired value for the position in a loop memory for at least a period of time required by the control, the valve, and the actuator to operate, said computing device being further arranged so as to feed the desired value for position to a summing member of a closed loop, said closed loop having an output which is added to said valve control value to achieve correction thereof.

7. A control system for a hydraulic actuator and an associated electrically controlled valve which determines an amount of operating fluid to be supplied to said actuator in response to an electrical valve control signal, said control system comprising:

a high speed computing device for continuously calculating a valve control value based upon:

a predetermined curve of at least one operating parameter of the actuator, said operating parameter being selected from a group of operating parameters consisting of a desired value for movement of the actuator, a desired value for pressure in the actuator, and a desired value for a force exerted by the actuator; and at any given time, at least one state variable indicative of a present state of the actuator at a time of calculation, said at least one state variable including a state variable indicative of a pressure differential between control edges of the valve, said valve control value being applied to said valve as said electrical valve control signal, wherein said computing device is arranged so as to calculate the desired value for position, force, or pressure of the actuator and is further arranged so as to store said desired value for position, force, or pressure in a loop memory for at least a time required by the control, the valve, and the actuator to operate, said desired value for position, force, or pressure being stored in said loop memory before the desired value for position, force, or pressure is fed to a closed loop and before an output signal of the closed loop is added to the valve control value via a summing member.

* * * * *